US005727305A

United States Patent [19]

Alvité et al.

[11] Patent Number: 5,727,305

[45] Date of Patent: Mar. 17, 1998

[54] PROGRAMMABLE PIN FEEDER

[76] Inventors: Joseph Alvité, 353 Aspen Rd., Wyoming, Minn. 55092; Charles J. Schiprett, 1427 Woodhill Rd., Burnsville, Minn. 55337; Glen R. Westphal, 2110 Ridge Dr. South, #22, St. Louis Park, Minn. 55416

[21] Appl. No.: 591,865

[22] Filed: Jan. 25, 1996

[51] Int. Cl.[6] ..... H01R 43/00

[52] U.S. Cl. ..... 29/566.2; 29/564.6

[58] Field of Search ..... 29/564.6, 564.8, 29/566.2, 566.3, 33 M, 879, 845, 884, 883; 404/412; 221/25

[56] References Cited

U.S. PATENT DOCUMENTS

| | | | |
|---|---|---|---|
| 4,365,398 | 12/1982 | Chisholm | 29/845 |
| 4,543,714 | 10/1985 | Seffernick et al. | 29/739 X |
| 4,589,188 | 5/1986 | Houtz et al. | 29/566.2 |
| 4,598,471 | 7/1986 | Elsbree, Jr. | 29/564.6 Y |
| 4,672,735 | 6/1987 | Tamano | 29/564.6 |
| 4,763,412 | 8/1988 | Basavanhally et al. | 29/564.6 |
| 4,817,279 | 4/1989 | Rapp | 29/564.6 |
| 5,337,468 | 8/1994 | Zahn | 29/842 |
| 5,605,430 | 2/1997 | Legrady | 414/412 |

FOREIGN PATENT DOCUMENTS

| | | | |
|---|---|---|---|
| 2003759 | 3/1979 | Germany | 29/564.6 |
| 8503022 | 7/1985 | WIPO | 29/564.6 |
| WO 93/13640 | 7/1993 | WIPO . | |

OTHER PUBLICATIONS

Reel Solutions from Autosplice, Inc., autosplice Innovative Interconnections Brochure, 1994, 12 pp.

*Primary Examiner*—William R. Briggs
*Attorney, Agent, or Firm*—Faegre & Benson LLP

[57] ABSTRACT

A programmable pin feeder for use in connection with an automated component assembly system, for providing pin headers from a supply reel containing a continuous carrier strip of the pins. The feeder includes a motor for indexing the carrier strip, a pin removing mechanism for removing pins from the carrier strip, a pin crimping mechanism for crimping pins in the carrier strip, a gripper for releasably gripping the pin headers at a pick-up station, and a cutter for cutting the headers from the carrier strip. A programmable logic controller is responsive to Pin Count, Pin Configuration and Pin Crimping instructions, and actuates the motor, pin removing mechanism, pin crimping mechanism, gripper and cutter as a function of the instructions to provide the desired pin headers.

20 Claims, 8 Drawing Sheets

PROGRAMMABLE PIN FEEDER

BACKGROUND OF THE INVENTION

1. Field of the Invention

The present invention relates generally to component feeders used in connection with automated electronic component assembly systems. In particular, the present invention is a programmable feeder for providing pin and other connector sections of desired lengths and configurations from a supply reel containing a continuous strip of the connectors.

2. Description of the Related Art

Automated systems for assembling electronic circuit boards and other types of components are commercially available from a number of manufacturers. One such system manufactured by Robodyne Corporation of Minneapolis, Minn., includes a gantry-mounted pick-and-place tool head. The tool head is driven in x and y directions across a work cell by linear motors or other actuators. Printed circuit boards (PCBs) to be assembled are positioned within the work cell, while electronic and mechanical components to be mounted on the circuit boards are supplied by feeders which are mounted to the assembly system or otherwise positioned on the edge of the work cell. The component assembly system is controlled by a computer which causes the tool head to pick components from the feeders and place the components at appropriate locations on the circuit boards.

One commonly used type of component feeder is known as a bowl feeder. Bowl feeders include a vibrating bowl which is periodically filled with a supply of the components. A channel or track which is sized and shaped to permit the passage of one component at a time in a predetermined orientation extends from the bowl. The vibratory motion of the bowl causes the components to serially enter and move along the track to a pick-up station. The automated assembly system then accesses the components at the pick-up station.

Another commonly used type of component feeder is known as a tube feeder. Many electronic components are packaged in elongated plastic tubes. Tube feeders are adapted to receive the tubes, and include a pushing mechanism which pushes the components out of the tubes to a pick-up station.

Electronic components are also often supplied on reels of flexible carrying tape. One such tape packaging system and a component feeder for use therewith is disclosed in International Publication Number WO 93/13640.

Continuous plastic carrier strips of pins, tabs, sockets, terminals and other electrical connectors are also supplied on reels. Connectors of these types are disclosed in the Zahn U.S. Pat. No. 5,337,468. Machines for cutting headers (sections of one or more connectors from the carrier strips) and for inserting the headers in circuit boards are commercially available from Autosplice of San Diego, Calif.

Packaging systems and associated feeders of the type described above are effectively dedicated to individual components. Separate inventories and feeders are therefore required for each individual component to be mounted on a circuit board by an automated assembly system. For example, if several different pin headers (e.g., different lengths of pin numbers or different pin spacings) are required for a given circuit board, a separate inventory and feeder is needed for each such header. The costs associated with the manufacture and inventory of these different parts is relatively high. The area available on the assembly systems for feeders is also limited.

It is evident that there is a need for improved connector feeding systems. In particular, there is a need for flexible connector feeders that can supply a number of different headers. Feeders of this type would greatly increase the efficiency of automated circuit board manufacturing operations. Fewer different headers would have to be inventoried, and the number of feeders needed to assemble any given circuit board reduced. Any such feeder must also be relatively fast and reliable.

SUMMARY OF THE INVENTION

The present invention is an improved pin or other connector feeder for use in connection with automated component assembly systems. The connector feeder is programmable, and capable of providing connector headers of desired lengths from a supply reel containing a continuous carrier strip of the connectors. One embodiment of the feeder includes a connector supply input adapted for receiving a supply of connectors in a continuous carrier strip, and a pick-up station at which connector headers are provided to the automated component assembly system. The carrier strip is supported and guided between the supply input and the pick-up station by a guide. A drive mechanism advances the carrier strip through the guide between the supply input and the pick-up station. A cutter between the supply input and pick-up station cuts the connector headers from the carrier strip. A control system is coupled to the drive mechanism and the cutter, and includes connector count input means, drive control means and cutter actuating means. Connector count data representative of desired numbers of connectors on the headers is received at the connector count input means. The drive control means actuates the drive mechanism as a function of the connector count data. The cutter actuating means actuates the cutter to cut headers having the desired connector counts from the carrier strip.

Another embodiment of the connector feeder includes a gripper for releasably gripping the headers at the pick-up station. The control system is coupled to the gripper and further includes gripper actuating means for causing the gripper to hold the headers after the headers have been advanced to the pick-up station and before the headers are cut from the carrier strip. The control system also causes the gripper to release the headers when the headers are to be provided to the automated component assembly system.

Yet another embodiment of the connector feeder includes a connector removal mechanism for removing connectors from the carrier strip. The control system is coupled to the connector removal mechanism and further includes connector removal input means and connector removal actuating means. The connector removal input means receives data representative of desired connectors to be removed from the headers. The connector removal actuating means actuates the connector removal mechanism and causes desired connectors to be removed from the carrier strip.

Still another embodiment of the connector feeder includes a connector crimping mechanism for crimping connectors on the carrier strip. The control system is coupled to the connector crimping mechanism and further includes connector crimping input means and connector crimping actuating means. The connector crimping input means receives data representative of desired connectors to be crimped on the headers. The connector crimping actuating means actuates the connector crimping mechanism and causes desired connectors on the carrier strip to be crimped.

DETAILED DESCRIPTION OF THE PREFERRED EMBODIMENTS

Figure 1:
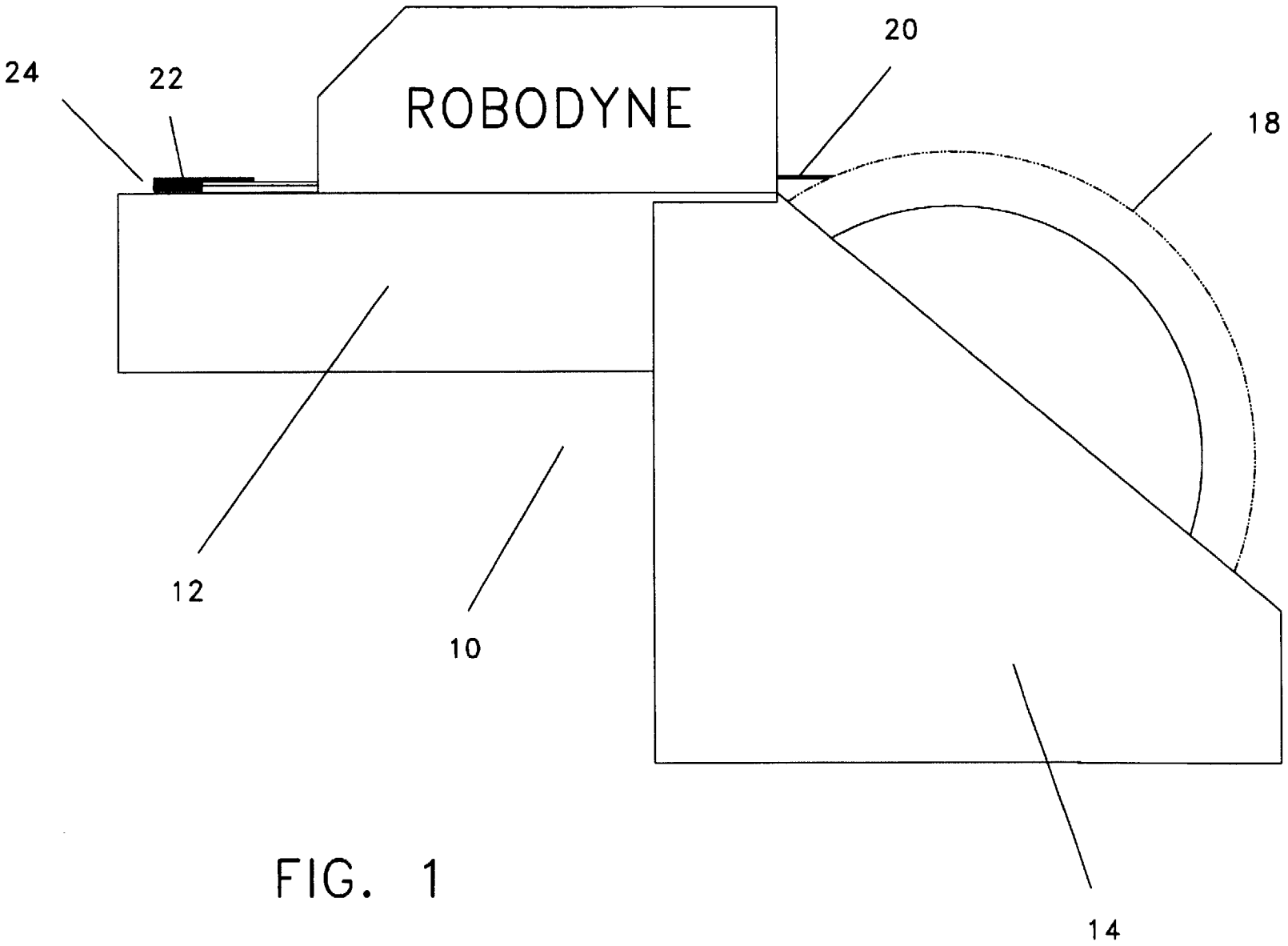
FIG. 1 is a side view of a programmable pin feeder in accordance with the present invention, shown in operation with a supply reel containing a continuous carrier strip of pins.
Figure 2:
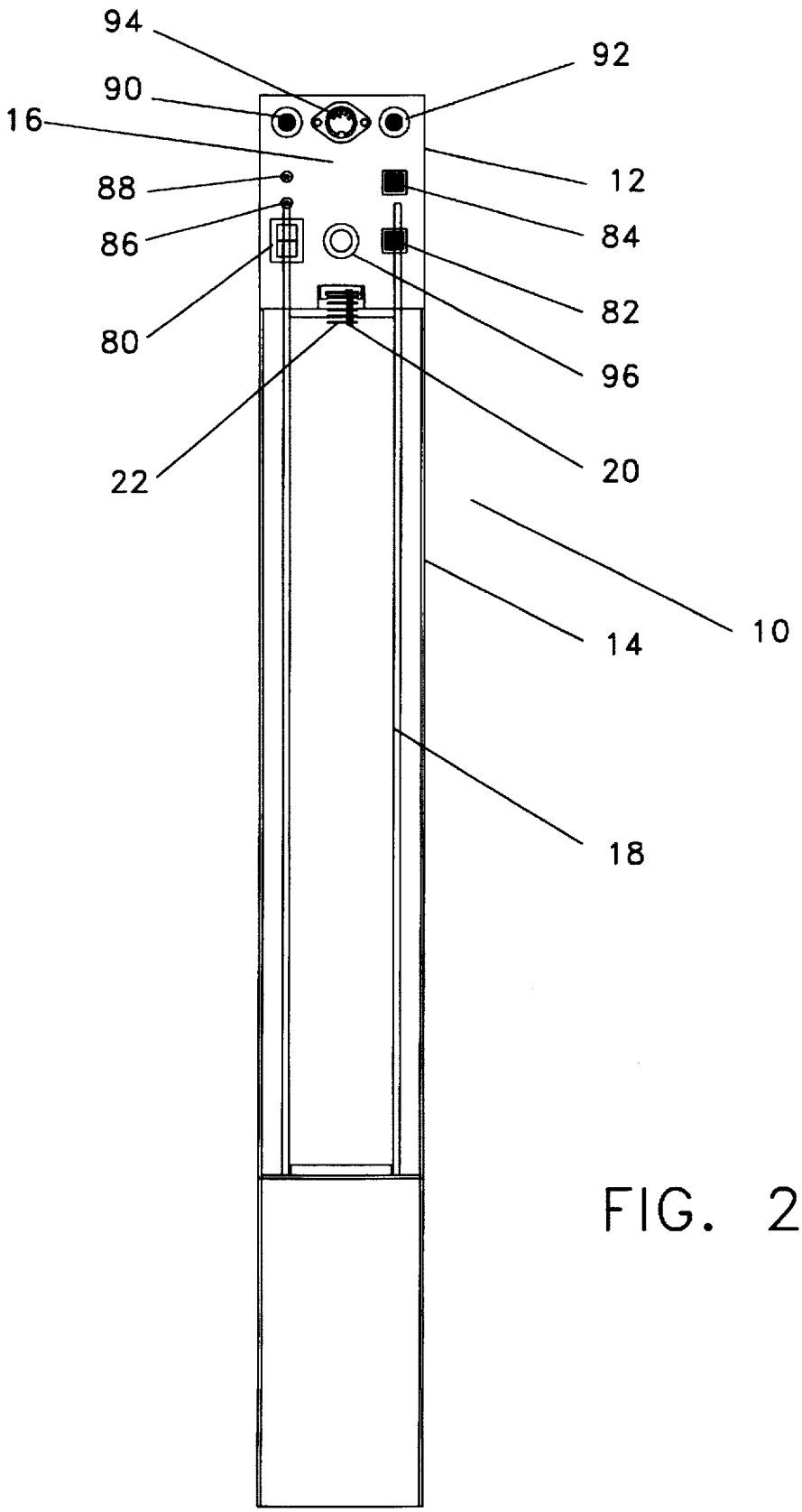
FIG. 2 is an end view of the pin feeder shown in FIG. 1.

A programmable pin (i.e., connector) feeder 10 in accordance with the present invention is illustrated generally in FIGS. 1 and 2. Pin feeder 10 is configured to be mounted and electronically interfaced to an automated component assembly system (not shown), and includes a component housing 12 and a reel holder assembly 14. An operator interface panel 16 is positioned on the end of housing 12, above the reel holder assembly 14. A supply reel 18 containing a continuous, molded plastic carrier strip 20 of pins 22 or other connectors is supported within the holder assembly 14. In response to instructions from the automated component assembly system indicating the desired pin count (i.e., the length of the header or section in terms of the number of pins) and desired pin configuration or spacing (i.e., which, if any, pins are to be crimped or removed from the section), feeder 10 crimps and removes selected pins 22 from carrier strip 20. The pin header is then cut from the carrier strip 20 and presented to the automated component assembly system at a pick-up station 24.

Figure 3:
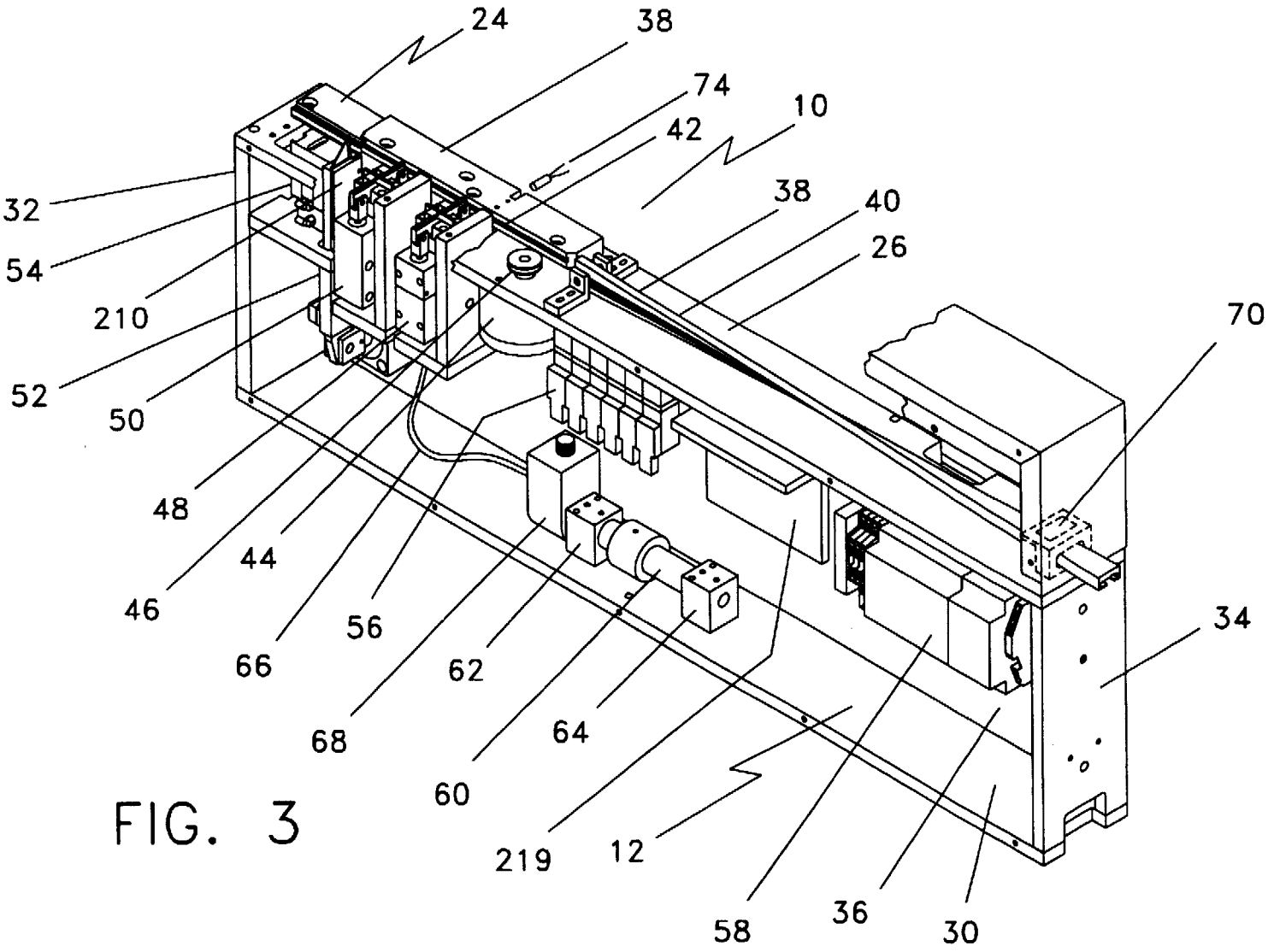
FIG. 3 is an isometric view of the housing of the pin feeder shown in FIG. 1, with the side panel removed and portions cut away to illustrate the components of the feeder.

Pin feeder 10 can be described in greater detail with reference to FIG. 3. As shown, component housing 12 includes top and bottom wall panels 26 and 30, forward and rearward end panels 32 and 34, and a pair of side panels 36 (only one of which is shown in FIG. 3). The carrier strip 20 is guided from the reel holder assembly 18 (not shown in FIG. 3) to pick-up station 24 by a guide 38. Guide 38 includes a track which holds and orients the carrier strip 20 as the strip is advanced through the feeder. Section 40 of guide 38 rotates the carrier strip 20 ninety degrees from the pins horizontal orientation at which the carrier strip comes off reel 18, to the pins vertical orientation. Section 42 of guide 38 supports the carrier strip 20 in the pins vertical orientation at which the carrier strip is processed by the various components of the feeder 10. Section 42 of guide 38 is formed by two members (only one is shown in FIG. 3) which are adjustably mounted to top wall panel 26 to accommodate carrier strips such as 20 of varying widths (e.g., differing numbers of rows of components). The carrier strip 20 is indexed or driven through the guide 38 by stepper motor 44. Motor 44 includes a drive gear 46, and is mounted adjacent to guide 38 so the drive gear will engage pins 22 of the carrier strip.

A pin removing mechanism 48, pin crimping mechanism 50 and cutter 52 are located along guide 38 between motor 44 and pick-up station 24. A gripper 54 is located below pick-up station 24, adjacent to cutter 52 and the downstream end of guide 38. Pin removing mechanism 48, pin crimping mechanism 50, cutter 52 and gripper 54 are all pneumatically actuated devices, and are coupled to a source of compressed air (not shown) by solenoid valves 56. Solenoid valves 56 are coupled to and controlled by programmable logic controller (PLC) 58. PLC 58 is also interfaced to drive motor 44 through a motor controller 219 which is mounted to bracket 36.

A vacuum generator 60 is mounted to bottom wall panel 30 by brackets 62 and 64, and coupled to pin removal mechanism 48 by vacuum hose 66. Pins 22 removed from the carrier strip 20 by pin removal mechanism 48 are drawn into a waste pin tray (not shown) through hose 66 by the low pressure created by vacuum generator 60. An inductive pin removal sensor 68 is located between pin removing mechanism 48 and vacuum generator 60. The pin removal sensor 68 is coupled to PLC 58 and generates detected pin signals when a removed pin passes by the sensor. PLC 58 can thereby monitor the operation of pin removing mechanism 48.

Figure 7:
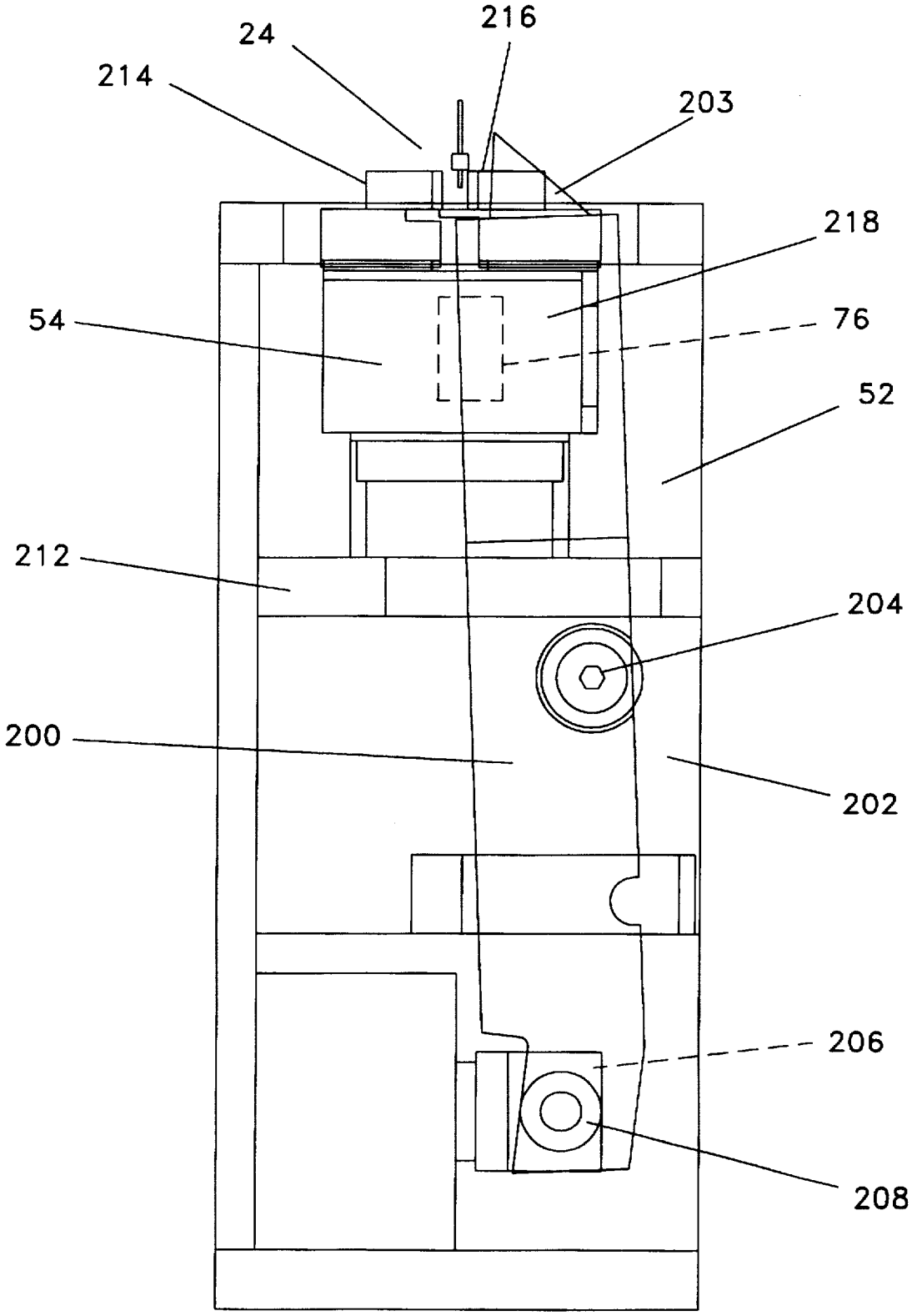
FIG. 7 is a detailed view of the gripper and cutter shown in FIG. 3, with the gripper jaws open to receive the carrier strip of pins, and the cutter in its retracted position.
Figure 8:
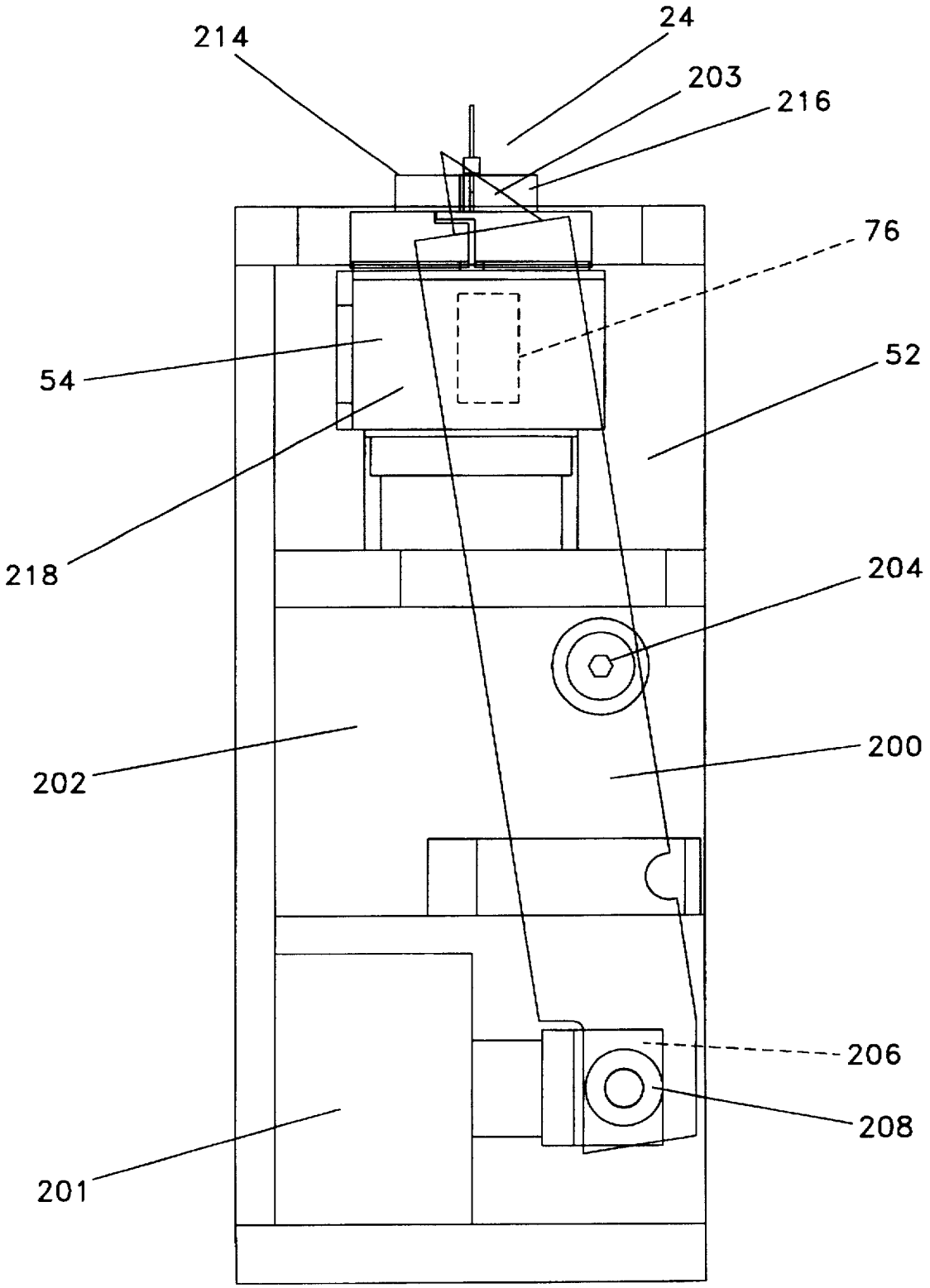
FIG. 8 is a detailed side view of the gripper and cutter shown in FIG. 3, with the gripper jaws closed to clamp the carrier strip of pins and the cutter its extended position severing a pin header from the carrier strip.

An opto-electronic parts low sensor 70 is mounted to the upstream end of section 40 of guide 38. Parts low sensor 70 is coupled to PLC 58, and provides parts low signals to the PLC when the supply of pins 22 on reel 18 is exhausted. An opto-electronic pin count sensor 74 is positioned between gripper 54 and section 40 of guide 38. Although shown in exploded form in FIG. 3, pin count sensor 74 is mounted within section 42 of guide 38, upstream from and adjacent to pin removing mechanism 48. Pin count sensor 74 is interfaced to PLC 58, and provides pin count signals representative of the number of pins advanced past cutter 52. As shown in FIGS. 7 and 8, gripper 54 includes a jaw position sensor 76. Jaw position sensor 76 is coupled to PLC 58, and provides jaw position signals indicating whether gripper 54 is open or closed.

As shown in FIG. 2, interface panel 16 includes on/off switch 80, reset switch 82 and part advance switch 84, all of which are coupled to PLC 58. The interface panel 16 also includes a power indicator 86, part ready indicator 88, low parts indicator 90 and error indicator 92. Indicators 86, 88, 90 and 92 are all LEDs and are coupled to PLC 58. An RS 232 communications port 94 through which PLC 58 is interfaced to the computer of the automated assembly system, and a fuse 96, are also located on interface panel 16.

Figure 4:
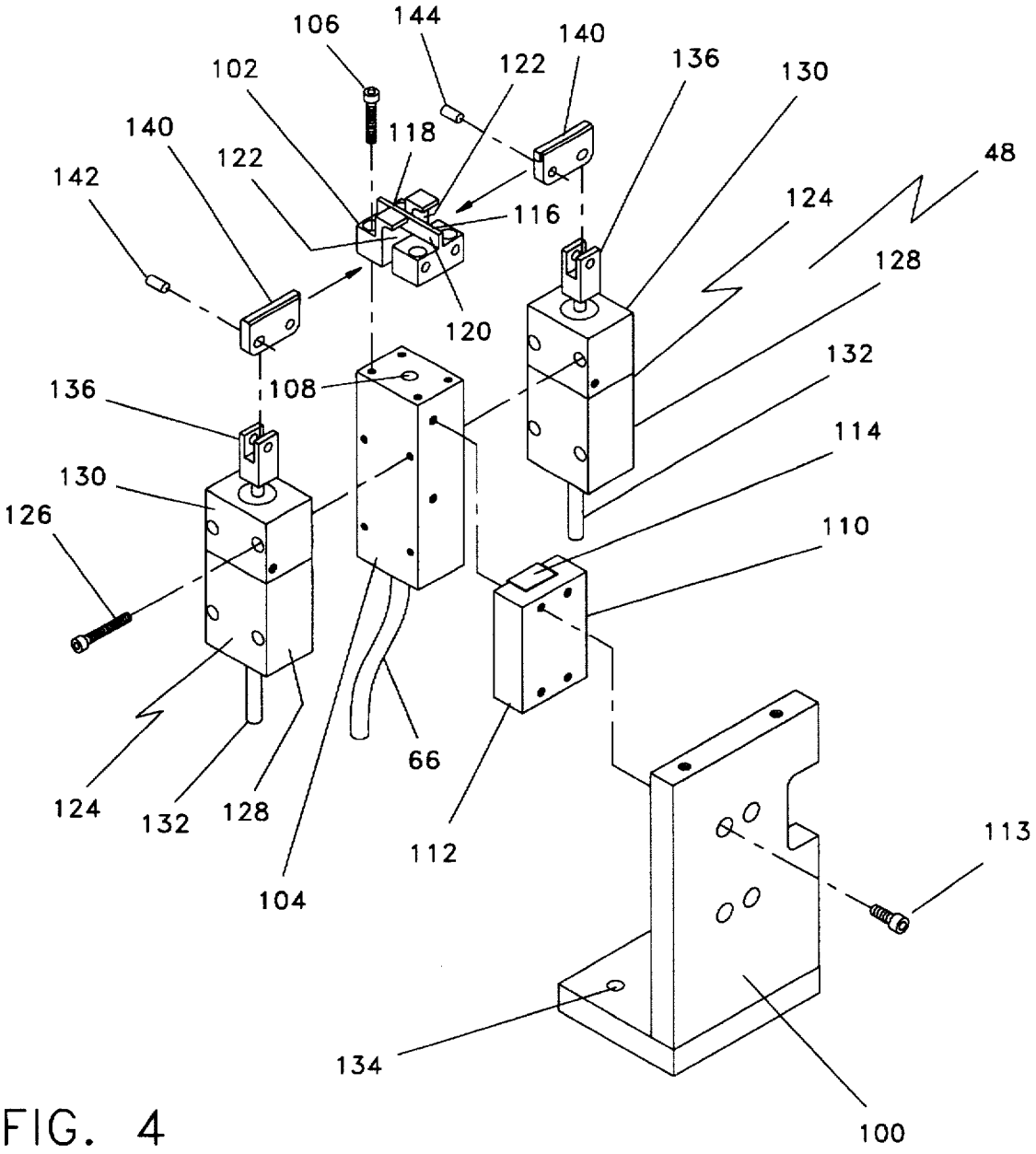
FIG. 4 is a detailed exploded isometric view of the pin removal mechanism shown in FIG. 3.

FIG. 4 is an exploded view of pin removing mechanism 48. As shown, pin removing mechanism 48 is mounted to bracket 100 and includes an anvil 102 which is fastened to anvil block 104 by screws such as 106. A bore 108 having an opening adjacent to anvil 102 extends through anvil block 104. Vacuum hose 66 is connected to the end of bore 108 opposite anvil 102. Anvil block 104 is mounted to bracket 100 by slide mount 110. Slide mount 110 includes a member 112 which is fixedly mounted to bracket 100 by screws such as 113, and a slide member 114 which is fixedly mounted to anvil block 104 (e.g., by screws, not shown). Slide member 114 is configured for slidable vertical motion with respect to member 112, enabling anvil block 104 and anvil 102 to be raised and lowered with respect to bracket 100.

Anvil 102 includes an elongated carrier strip support 116 having an upper edge 118 and a pair of side surfaces 120. A pair of clevis slots 122 extend through anvil 102 on opposite side of the carrier strip support 116. The support 116 is oriented parallel to the direction of motion of the carrier strip 20. When feeder 10 is used with carrier strips 20 having two or more rows of pins 20, the carrier strip can ride on upper edge 118 with the rows of pins extending downwardly on opposite sides of the side surfaces 120. When used with carrier strips 20 having a single row of pins 22, guide 38 can support the carrier strip on one side of the pins while the upper edge 118 of carrier strip support 116 supports the opposite side of the carrier strip.

A pair of pneumatic cylinder assemblies 124 are mounted to opposite sides of anvil block 104 by screws such as 126. Each cylinder assembly 124 includes a pulling cylinder 128 and a clamping cylinder 130. Pulling cylinders 128 have downwardly extending shafts 132 which are fixedly mounted to bracket 100 at locations 134. Clamping cylinders 130 have upwardly extending shafts which terminate at clevis brackets 136. The supply of compressed air used to actuate cylinders 128 and 130 (not shown) is regulated by solenoid valves 56 in response to control signals from PLC 58. A clevis 140 is pivotally mounted to each bracket 136 by a pin 142. The ends of clevises 140 opposite brackets 136 extend into the clevis slots 122 of anvil 102, and are pivotally mounted to the anvil by a pin 144.

The operation of pin pulling mechanism 48 is controlled by PLC 58. When no pins 20 are to be pulled from carrier strip 20, PLC 58 causes pulling cylinders 128 to be actuated in such manner as to drive anvil block 104 to an upwardly or extended position at which the carrier strip support 116 functions as a guide, and does not interfere with the motion of carrier strip 20 or pins 22 as they are driven through the feeder 10. When pins 22 are to be removed from the carrier strip 20, the pins to be removed are positioned on the carrier strip support 116 at a position adjacent to clevises 140. PLC 58 then actuates clamping cylinders 130 to clamp the pins to be removed between the edge of clevis 140 and the side surfaces 120 of the carrier strip support 116. With the pins 22 to be removed clamped to anvil 102, PLC 58 causes pulling cylinders 128 to be actuated in such a manner as to drive anvil block 104, and therefore the anvil, to a downwardly or retracted position. This downward motion pulls the pins 22 from the carrier strip 20. Clamping cylinders 130 are then actuated to release clevises 140, and to allow the removed pins 22 to be drawn into bore 108 by the vacuum created by vacuum generator 60. PLC 58 can confirm the removal of the pins 22 by monitoring the detected pin signals received from sensor 68. Clevises 140 can be operated independently or together to remove either or both pins from a two pin row carrier strip 20 in the embodiment shown.

Figure 5:
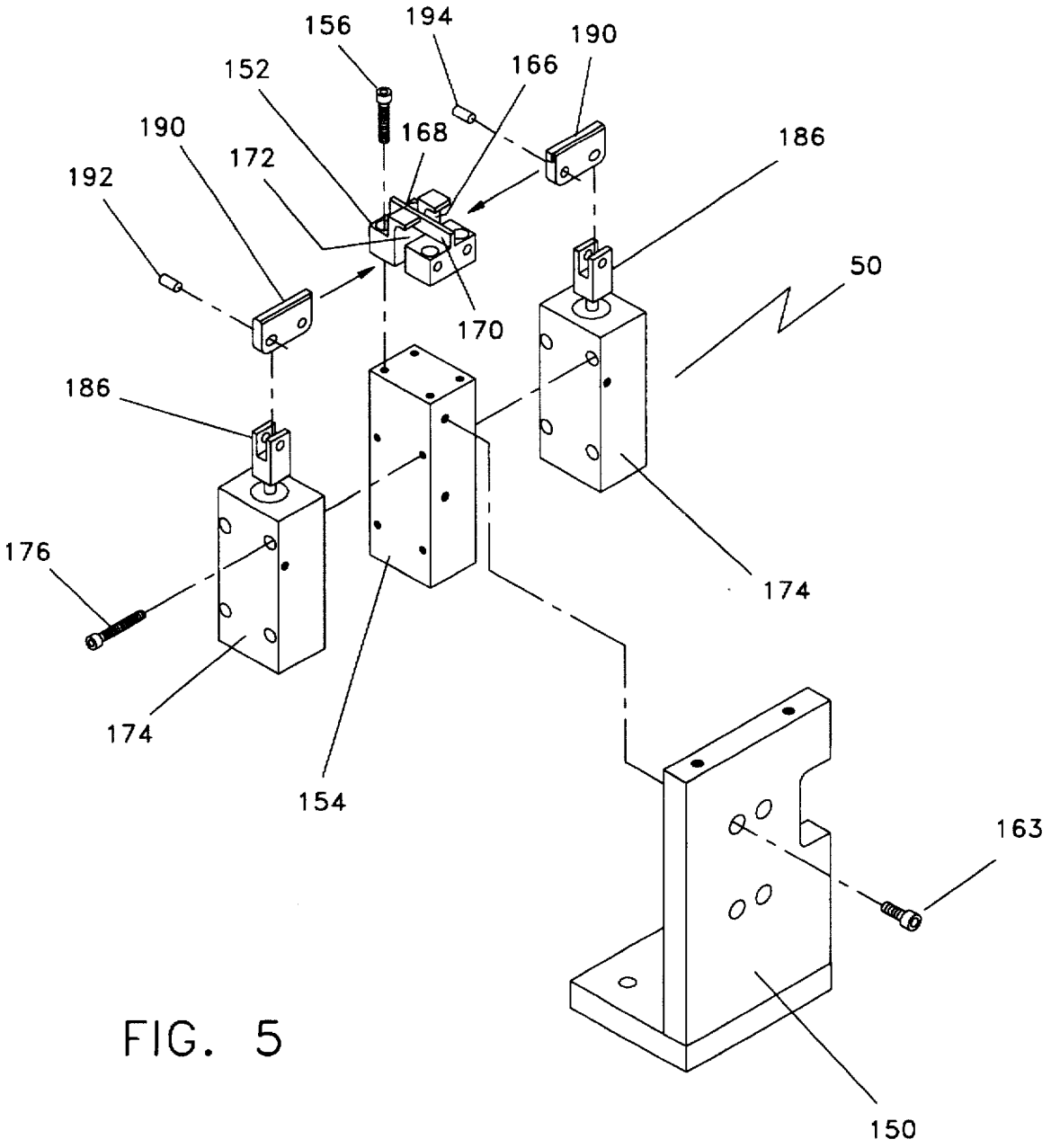
FIG. 5 is a detailed exploded isometric view of the pin crimping mechanism shown in FIG. 3.

FIG. 5 is an exploded view of pin crimping mechanism 50. As shown, pin crimping mechanism 50 is mounted to bracket 150 and includes an anvil 152 which is fastened to anvil block 154 by screws such as 156. Anvil block 154 is mounted to bracket 150 by screws such as 163. Anvil 152 includes an elongated carrier strip support 166 having an upper edge 168 and a pair of side surfaces 170. A pair of clevis slots 172 extend through anvil 152 on opposite side of the carrier strip support 166. The support 166 is oriented parallel to the direction of motion of the carrier strip 20. When feeder 10 is used with carrier strips 20 having two or more rows of pins 22, the carrier strip can ride on upper edge 168 with the rows of pins extending downwardly on opposite sides of the side surfaces 170. When used with carrier strips 20 having a single row of pins 22, guide 38 can support the carrier strip on one side of the pins while the upper edge 168 of carrier strip support 166 supports the opposite side of the carrier strip.

A pair of pneumatic crimping cylinders 174 are mounted to opposite sides of anvil block 154 by screws such as 176. Crimping cylinders 174 have upwardly extending shafts which terminate at clevis brackets 186. The supply of compressed air (not shown) used to actuate cylinders 174 is regulated by solenoid valves 56 in response to control signals from PLC 58. A clevis 190 is pivotally mounted to each bracket 186 by a pin 192. The ends of clevises 190 opposite brackets 186 extend into the clevis slots 172 of anvil 152, and are pivotally mounted to the anvil by pins 194.

Figure 6:
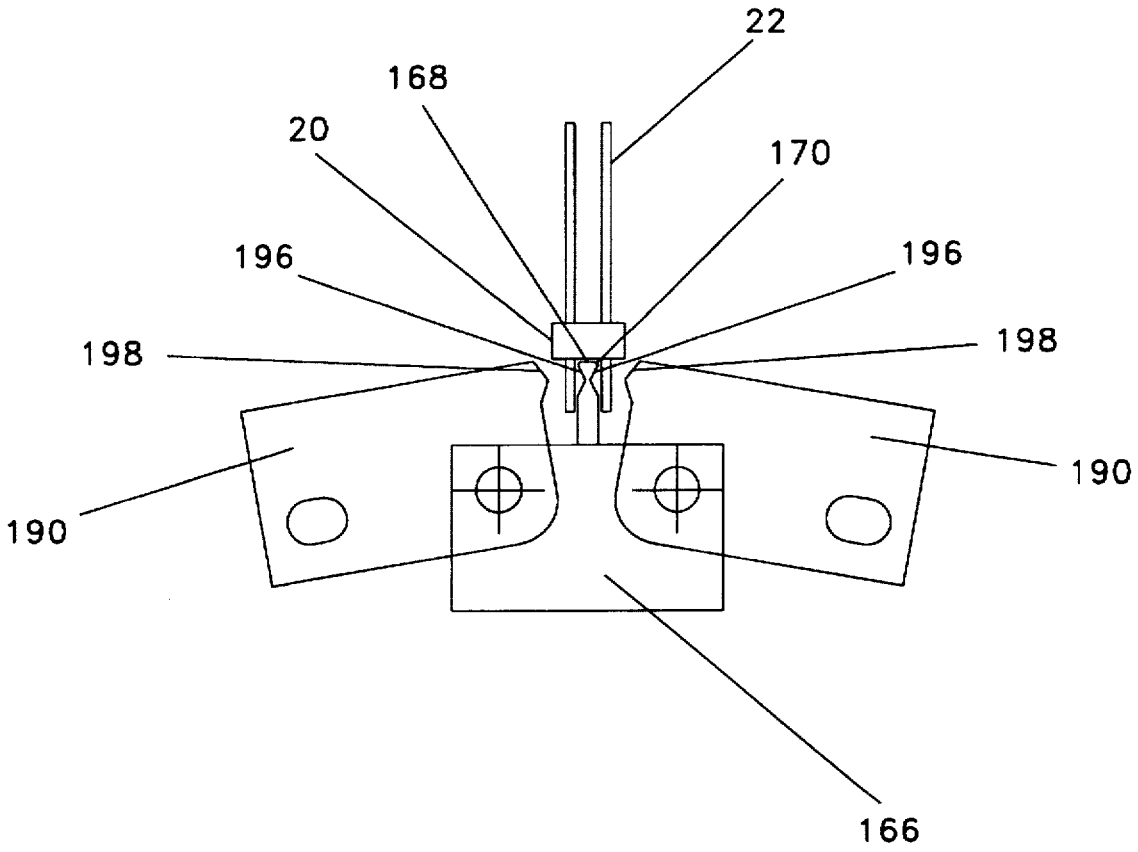
FIG. 6 is a detailed view of the anvil and clevises of the pin crimping mechanism shown in FIG. 5.

As perhaps best shown in FIG. 6, the side surfaces 170 of the carrier strip support 166 adjacent to clevises 190 include crimping recesses 196. The edges of clevises 190 include crimping projections 198. The operation of pin crimping mechanism 50 is controlled by PLC 58. When no pins 22 are to be crimped, PLC 58 causes crimping cylinders 174 to be actuated in such manner as to retract clevises 190. The carrier strip support 166 will then function as a guide, and does not interfere with the motion of carrier strip 20 or pins 22 as they are driven through the feeder 10. When pins 22 are to be crimped, the pins are positioned on the carrier strip support 166 at a position adjacent to clevises 190. PLC 58 then actuates crimping cylinders 174 to drive clevises 190 into engagement with the pins 22 and toward carrier strip support 166. Crimping projections 198 thereby force the pins 22 into recesses 196 to deform or crimp the pins. Crimping cylinders 174 are then actuated to release clevises 190. Clevises 190 can be operated independently or together to crimp either or both pins from a two pin row carrier strip 20 in the embodiment shown.

Cutter 52 and gripper 54 can be described with reference to FIGS. 7 and 8. Cutter 52 includes a cutter arm 200, pneumatic actuating cylinder 201 and blade 203. The cutter arm 200 is mounted to bracket 202 by pivot mount 204, and is positioned with the blade adjacent to and downstream from the downstream end of section 42 of guide 38. Actuating cylinder 201 is mounted to housing side panel 36 and has a shaft which terminates with a bracket 206. Bracket 206 is mounted to the lower end of cutter arm 200 by pivot mount 208. The supply of compressed air used to actuate cylinder 201 is regulated by solenoids 56 in response to control signals from PLC 58. The upper end of cutter arm 200 includes a recess (not visible) which is sized to receive conventional utility knife blade 203. As shown in FIG. 3, the blade 203 is removably retained within the recess by a cover plate 210.

Gripper 54 is mounted to bracket 212 and includes a pair of jaws 214 and 216 which are driven between open and closed positions by a pneumatic drive mechanism 218. The supply of compressed air used to actuate drive mechanism 218 is regulated by solenoids 56 in response to control signals from PLC 58. A jaw position sensor 76 is mounted to gripper 54 and provides jaw position signals to PLC 58 representative of whether jaws 214 and 216 are open or closed. Grippers such as 54 are well known and commercially available from a number of sources including Schunk Intec of Raleigh, N.C. By way of example, a Schunk Intec Type RH 918 gripper can be used in feeder 10.

The operation of cutter 52 and gripper 54 are controlled by PLC 58. When a section of carrier strip 20 is being advanced to pick-up station 24, PLC 58 causes cutter cylinder 201 to be actuated in such a manner as to drive arm 200 and blade 203 to the retracted position shown in FIG. 7. PLC 58 also actuates gripper 54 in such a manner as to drive jaws 214 and 216 to the open position shown in FIG. 7. After the desired length header of carrier strip 20 has been advanced to the pick-up station 24, PLC 58 causes gripper 54 to force jaws 214 and 216 to the closed position shown in FIG. 8, engaging and holding the header of the carrier strip at the pick-up station. Cutter arm 200 is then driven to the extended position shown in FIG. 8, with blade 203 cutting the header of the carrier strip 20 held by gripper 54 from the portion of the carrier strip in guide 38.

Prior to operation, feeder 10 is installed on an automated component assembly system (not shown) with the pick-up station 24 positioned adjacent to the work cell. Communication port 94 is then coupled to the computer of the assembly system (not shown). A supply of compressed air is also coupled to feeder 10 through a quick disconnect fitting (not shown).

The set-up for operation for feeder 10 begins by positioning a supply reel 18 of pins 22 within reel holder assembly 14. The end of carrier strip 20 is then manually inserted into the upstream end of guide 38, and fed into the guide until the end of the carrier strip engages the motor drive gear 46. On/off switch 80 is actuated to supply power to the components of feeder 10. Power indicator 86 will be illuminated whenever feeder 10 is on. Part ready indicator 88 is illuminated when a header is available at pick-up station 24. Low parts indicator 90 is illuminated when only a limited supply of connectors is available, and a new supply will be needed soon. When the usable supply of connectors is exhausted, both the parts low indicator 90 and the error indicator 92 are illuminated. Part advance switch 84 can be actuated to feed the carrier strip 20 forward. Reset switch 82 is actuated to clear an error after the problem has been corrected. Error indicator 92 is illuminated to indicate a system fault, such as when sensor 76 indicates that gripper 54 failed to close on the header, and when pins 22 are not properly aligned with sensor 74.

Feeder 10 is configured to receive four instructions from the computer of the assembly system. The first is a Pin Count instruction describing the length of the header to be cut from the carrier strip 20 in terms of the number of pins. The second is a Pin Configuration instruction describing which, if any, pins are to be removed from the header. The third is a Pin Crimping instruction describing which, if any, pins of the header are to be crimped. The fourth is an OK To Cut instruction which initiates the header preparation operation by feeder 10. The OK To Cut signal is held on until the assembly system has engaged or gripped the header at the pick-up station. PLC 58 also provides a Feeder Ready instruction to the computer of the assembly system when feeder 10 has a completed header ready at the pick-up station.

Feeder 10 initiates a header preparation operation upon the receipt of an OK To Cut instruction. During the header preparation operation PLC 58 actuates motor 44 to index the carrier strip 20 while at the same time coordinating the actuation of pin removing mechanism 48 and pin crimping mechanism 50 to remove and crimp pins 22 in accordance with the Pin Removal instruction and the Pin Crimping instruction. Detected pin signals from sensor 68 are monitored by PLC 58 during this operation to ensure that the header will have the proper pin configuration. The header preparation operation continues with the header of the carrier strip 20 being indexed past cutter 52 and into the open jaws 214 and 216 of gripper 54. Pin count signals provided by pin count sensor 74 are used by PLC 58 to ensure that the header of the carrier strip 20 indexed to pick-up station 24 has the proper length in accordance with the Pin Count instruction. After the header of the carrier strip 20 has been indexed to the pick-up station 24, PLC 58 causes the gripper 54 to engage and hold the section by closing jaws 214 and 216. PLC 58 then actuates cutter 52 to cut the header from the carrier strip 20, and provides the Feeder Ready instruction to indicate that the header preparation operation is complete and the desired part is available at the pick-up station 24. Gripper 54 is subsequently actuated to release the header only when the OK To Cut instruction is discontinued.

Feeder 10 offers considerable advantages. In particular, all terminal headers of different lengths and configurations required for a circuit board can be provided by one feeder. The different terminal headers need not be separately manufactured and inventoried. The feeder is relatively fast, accurate and reliable.

Continuous carrier strips of connectors such as pins 22 are commercially available from Autosplice of San Diego, Calif. and other manufacturers. Although the preferred embodiment of the invention described herein is a pin feeder, many other types of connectors such as tabs, sockets, lugs, bobbins, terminals, shunts and posts are available in continuous carrier strips or otherwise in continuous form in both single and multiple rows. The invention can be adapted to provide different part count and part spacing sections of these connectors as well. Furthermore, although packaged in reels for convenience of shipping and handling, the invention can be adapted to receive continuous carrier strips of components packaged in other forms.

Although the present invention has been described with reference to preferred embodiments, those skilled in the art will recognize that changes can be made in form and detail without departing from the spirit and scope of the invention.

What is claimed is:

1. A feeder for providing connector sections of varying lengths, from a supply of connectors in a continuous carrier strip, for pick-up, the feeder including:

a supply input adapted for receiving a supply of connectors in a continuous carrier strip;

a pick-up station at which connector sections are provided for pick-up;

a guide for supporting and guiding the carrier strip between the supply input and the pick-up station;

a drive mechanism for advancing the carrier strip between the supply input and the pick-up station;

a cutter between the supply input and pick-up station, for cutting connector sections from the carrier strip; and a control system coupled to the drive mechanism and the cutter, including:

section length input means for receiving section length data representative of desired lengths of connector sections;

drive control means for actuating the drive mechanism as a function of the section length data; and cutter actuating means for actuating the cutter to cut connector sections of the desired lengths from the carrier strip.

2. The connector feeder of claim 1 wherein:

the pick-up station is adjacent to the cutter;

the drive control means causes the drive mechanism to advance connector sections of the desired lengths past the cutter to the pick-up station; and the cutter actuating means actuates the cutter after connector sections of the desired lengths have been advanced to the pick-up station.

3. The connector feeder of claim 2 wherein:

the feeder further includes a gripper for releasably gripping the connector sections at the pick-up station; and the control system is coupled to the gripper and further includes gripper actuating means for causing the gripper to hold connector sections after the sections have been advanced to the pick-up station and before the sections are cut from the carrier strip, and for causing the gripper to release the connector sections when the sections are to be provided to an automated component assembly system.

4. The connector feeder of claim 3 wherein:

the feeder further includes a connector count sensor coupled to the control system for sensing and providing connector count information representative of the advancement of connectors; and the drive control means of the control system actuates the drive mechanism as a function of the section length data and the connector count information.

5. The connector feeder of claim 1 wherein:

the feeder further includes a gripper for releasably gripping the connector sections at the pick-up station; and the control system is coupled to the gripper and further includes gripper actuating means for controlling the gripper.

6. The connector feeder of claim 1 and further including a connector count sensor coupled to the control system for providing information representative of the advancement of the carrier strip for determining the length of the connector sections.

7. The connector feeder of claim 1 wherein:

the feeder further includes a connector removing mechanism for removing connectors from the carrier strip; and the control system is coupled to the connector removing mechanism and further includes:

connector removal input means for receiving data representative of desired connectors to be removed from the connector sections; and connector removal actuating means for actuating the connector removing mechanism and causing desired connectors to be removed from the carrier strip.

8. The connector feeder of claim 7 wherein the connector removing mechanism is positioned between the supply input and the cutter.

9. The connector feeder of claim 7 and further including a vacuum hose for transporting the removed connectors from the connector sections.

10. The connector feeder of claim 9 and further including a vacuum generator mounted to the vacuum hose.

11. The connector feeder of claim 9 and further including a connector removal confirmation sensor coupled to the control system for providing connector removal information indicating whether the desired connectors have been removed from the connector sections.

12. The connector feeder of claim 11 and further including a connector removal alignment sensor coupled to the control system for providing connector-removing mechanism alignment information indicating whether the desired connectors to be removed are properly positioned with respect to the connector removing mechanism.

13. The connector feeder of claim 7 wherein the connector removing mechanism includes a gripper for releasably gripping the connectors and pulling the connectors from the carrier strip.

14. The connector feeder of claim 1 wherein cutter includes:

a pivoting arm;

a blade mounted to the arm; and an actuator coupled to the control system for driving the arm.

15. The connector feeder of claim 1 wherein the drive mechanism includes:

a motor; and a gear mounted to the motor for engaging the connectors and moving the carrier strip when the motor is actuated.

16. The connector feeder of claim 1 wherein:

the feeder further includes a connector crimping mechanism for crimping connectors on the carrier strip; and the control system is coupled to the connector crimping mechanism and further includes:

connector crimping input means for receiving data representative of desired connectors to be crimped on the connector sections; and connector crimping actuating means for actuating the connector crimping mechanism and causing desired connectors on the carrier strip to be crimped.

17. The connector feeder of claim 1 and further including a reel holder adjacent to the connector supply input, for holding a reel of the carrier strip.

18. The connector feeder of claim 1 and further including a base for releasably mounting the feeder to an automated component assembly system.

19. A connector feeder for use in connection with an automated component assembly system, for providing connector sections of desired lengths and pin spacings from a supply reel containing an elongated and continuous carrier strip of the connectors, the connector feeder including:

a base adapted to be mounted to an automated component assembly system;

a reel holder mounted to the base, for holding the supply reel of connectors;

a pick-up station adapted to present connector sections to an automated component assembly system;

a guide for supporting and guiding the strip of connectors between the reel holder and the pick-up station;

a drive mechanism for advancing the carrier strip through the guide toward the pick-up station;

a pin count sensor for providing pin count information representative of the lengths of the connector sections advanced to the pick-up station;

a pick-up station gripper for releasably gripping the connector sections at the pick-up station;

a cutter between the guide and the pick-up station for cutting the connector sections from the carrier strip;

a connector removing mechanism for removing desired connectors from the carrier strip; and a control system coupled to drive mechanism, pin count sensor, pick-up station gripper, cutter and pin removing mechanism, for controlling the feeder, the control system including:

input means for receiving:

section length data representative of the desired lengths of the connector sections to be cut from the carrier strip; and connector spacing data representative of the connector spacing configurations of the connector sections to be cut from the carrier strip;

connector removing mechanism control means for actuating the connector removing mechanism as a function of the connector spacing data so the connector sections at the pick-up station have the desired connector spacing configurations;

drive mechanism control means for actuating the drive mechanism as a function of the section length data and the connector count information to advance connector sections of the desired lengths to the pick-up station;

pick-up station gripper control means for causing the pick-up station gripper to engage and hold the connector sections advanced to the pick-up station while the sections are cut from the carrier strip, and for causing the pick-up station gripper to release the cut connector sections; and cutter control means for actuating the cutter.

20. The connector feeder of claim 19 wherein:

the feeder further includes a connector crimping mechanism for crimping connectors on the carrier strip; and the control system is coupled to the connector crimping mechanism and wherein:

the input means further includes means for receiving crimping data representative of desired connectors to be crimped; and the control system further includes crimping mechanism control means for actuating the crimping mechanism as a function of the crimping data so the connector sections at the pick-up have the desired connector crimping configuration.

* * * * *